US007028661B1

(12) United States Patent
Bonne et al.

(10) Patent No.: US 7,028,661 B1
(45) Date of Patent: Apr. 18, 2006

(54) METHOD AND CODE FOR CONTROLLING TEMPERATURE OF ENGINE COMPONENT ASSOCIATED WITH DEACTIVATABLE CYLINDER

(75) Inventors: Michael A Bonne, Leonard, MI (US); Mark J Duty, Goodrich, MI (US); Michael J Prucka, Grass Lake, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 11/064,603

(22) Filed: Feb. 24, 2005

(51) Int. Cl.
*F02B 77/00* (2006.01)

(52) U.S. Cl. ..... 123/198 F

(58) Field of Classification Search ..... 123/198 F
See application file for complete search history.

(56) References Cited

U.S. PATENT DOCUMENTS

| | | | | |
|---|---|---|---|---|
| 5,408,974 | A | 4/1995 | Lipinski et al. | |
| 5,813,383 | A * | 9/1998 | Cummings | 123/198 F |
| 2004/0244744 | A1 | 12/2004 | Falkowski et al. | |
| 2004/0244751 | A1 | 12/2004 | Falkowski et al. | |
| 2005/0022509 | A1* | 2/2005 | Fukusako et al. | 60/284 |

OTHER PUBLICATIONS

Bates, B.; Dosdall, J. M.; and Smith, D. H.; "Variable Displacement by Engine Valve Control," SAE Paper No. 780145 (New York, NY; 1978).

Mueller, Robert S.; and Uitvlugt, Martin W.; "Valve Selector Hardware," SAE Publication No. 780146 (New York, NY; 1978).

Fukui, Toyoaki; Nakagami, Tatsuro; Endo, Hiroyasu; Katsumoto, Takehiko; and Danno, Yoshiaki; "Mitsubishi Orion-MD—A New Variable Displacement Engine," SAE Paper No. 831007 (New York, NY; 1983).

Hatano, Kiyoshi; Iida, Kazumasa; Higashi, Hirohumi; and Murata, Shinichi; "Development of a New Multi-Mode Variable Valve Timing Engine," SAE Paper No. 930878 (New York, NY; 1993).

(Continued)

*Primary Examiner*—Noah P. Kamen
(74) *Attorney, Agent, or Firm*—Thomas A. Jurecko

(57) ABSTRACT

A method for controlling the operation of a deactivatable valve lifter of an internal combustion engine includes determining a first measure of heat loss from one or more components associated with a given deactivated cylinder based, for example, on the number of engine cycles that have occurred since cylinder deactivation. The given cylinder is reactivated when the component heat loss measure reaches a threshold level, as by comparing the first measure to a first predetermined threshold value. After cylinder reactivation, the given cylinder can thereafter be deactivated only after the temperature of the components has been restored to a nominal operating temperature, for example, as inferred from a second measure, representing the heat generated within the given cylinder subsequent to cylinder reactivation, determined based upon engine mass air flow or fuel flow. In this manner, the respective temperatures of such engine components are maintained above a desired minimum temperature.

19 Claims, 2 Drawing Sheets

OTHER PUBLICATIONS

McElwee, Mark; and Wakeman, Russell; "A Mechanical Valve System with Variable Lift, Duration, and Phase Using a Moving Pivot," SAE Paper No. 970334 (New York, NY; 1997).

Yacoub, Yasser; and Atkinson, Chris; "Modularity in Spark Ignition Engines: A Review of its Benefits, Implementation and Limitations," SAE Publication No. 982688 (New York, NY; 1998).

Zheng, Quan; "Characterization of the Dynamic Response of a Cylinder Deactivation Valvetrain System," SAE Publication No. 2001-01-0669 (New York, NY; 2001).

Leone, T.G.; and Pozar, M.; "Fuel Economy Benefit of Cylinder Deactivation—Sensitivity to Vehicle Application and Operating Constraints," SAE Paper No. 2001-01-3591 (New York, NY; 2001).

Patton, Kenneth J.; Sullivan, Aaron M.; Rask, Rodney B.; and Theobald, Mark A.; "Aggregating Technologies for Reduced Fuel Consumption: A Review of the Technical Content in the 2002 National Research Council Report on CAFÉ," SAE Paper No. 2002-01-0628 (New York, NY; 2002).

Falkowski, Alan G.; McElwee, Mark R.; and Bonne, Michael A.; "Design and Development of the Daimlerchrysler 5.7l Hemi Engine Multi -Displacement Cylinder Deactivation System," SAE Publication No. 2004-01-2106 (New York, NY, May 7, 2004).

* cited by examiner

METHOD AND CODE FOR CONTROLLING TEMPERATURE OF ENGINE COMPONENT ASSOCIATED WITH DEACTIVATABLE CYLINDER

FIELD OF THE INVENTION

The invention relates generally to methods and computer-executable code for controlling the operation of an internal combustion engine for a motor vehicle that features deactivatable cylinders.

BACKGROUND OF THE INVENTION

The prior art teaches equipping vehicles with "variable displacement," "displacement on demand," or "multiple displacement" internal combustion engines in which one or more cylinders may be selectively "deactivated," for example, to improve vehicle fuel economy when operating under relatively low-load conditions. Typically, the cylinders are deactivated through use of deactivatable valve train components, such as the deactivating valve lifters as disclosed in U.S. patent publication no. U.S. 2004/0244751 A1, whereby the intake and exhaust valves of each deactivated cylinder remain in their closed positions notwithstanding continued rotation of their driving cams.

Typically, the intake and exhaust valves of each deactivated cylinder are closed so as to trap combustion gases within each such cylinder, whereupon the deactivated cylinders operate as "air springs" to reduce engine pumping losses when the engine is operated with such cylinders in the deactivated state. When vehicle operating conditions are thereafter deemed to require an engine output torque greater than that achievable without the contribution of the deactivated cylinders, as through a heightened torque demand signal, the deactivatable valve train components are returned to their nominal activated state to thereby "reactivate" the deactivated cylinders.

There is a need, however, to determine whether a deactivated cylinder should be periodically reactivated, even when vehicle operating conditions do not otherwise require cylinder reactivation in response, for example, to a greater torque demand signal, in order to maintain the temperature of certain engine components associated with such deactivatable cylinders above respective desired minimum temperatures.

BRIEF SUMMARY OF THE INVENTION

In accordance with an aspect of the invention, a method and associated computer-executable code for controlling a temperature of a component of an internal combustion engine associated with a deactivated cylinder after the engine is switched to a cylinder-deactivation operating mode includes determining, during the cylinder-deactivation mode, a first measure representative of a component heat loss; and reactivating the cylinder when the first measure exceeds a first threshold value. While the invention contemplates basing the first measure on any suitable parameter, in an exemplary method, the heat loss is inferred from the number of engine cycles that have occurred since deactivation of the cylinder. Thus, in the exemplary method, the first measure is determined by accumulating the number of engine cycles that have occurred since cylinder deactivation, for example, by counting the number of engine position pulses generated by a Hall-effect crankshaft sensor.

In accordance with another aspect of the invention, the first threshold value is either a calibrated value or, more preferably, is representative of the initial conditions within the cylinder at the time of cylinder deactivation. Thus, in an exemplary method, the first threshold is itself determined as a function of at least one engine operating parameter, as detected or determined immediately before cylinder deactivation, such as parameters representing engine speed and load at deactivation. The invention contemplates use of additional parameters such as those representative of instantaneous mass air flow and air-fuel charge temperature (the latter perhaps being inferred from the output of an ambient air temperature sensor or an engine coolant temperature sensor), by which to further characterize the heat transfer properties of the cylinder's combustion chamber at cylinder deactivation.

In accordance with an aspect of the invention, the method and associated code advantageously maintain a temperature of a component associated with the given deactivatable cylinder, such as a piston rings or a spark plug, above a minimum temperature, even when enabling engine operation in the cylinder-deactivation mode.

In accordance with another aspect of the invention, once the cylinder-deactivation mode is discontinued and the given cylinder is reactivated, an exemplary method further includes determining a second measure representative of the heat that is subsequently generated within the reactivated cylinder, and allowing, as through use of a suitable "enable" flag, the subsequent deactivation of the given cylinder only after the second measure exceeds a second predetermined threshold value. While the invention contemplates use of any suitable measure of such generated heat, by way of example only, in an exemplary method, the second measure is determined by accumulating an approximation of engine load, such as accumulating sampled values for a mass air flow into the engine (perhaps based on a detected or determined engine intake manifold pressure). By way of further example only, the invention alternatively contemplates determining the second measure based on a fuel flow into the engine (as derived, for example, from fuel injector signal pulse width).

In accordance with yet another aspect of the invention, by limiting heat losses within a given deactivated cylinder, the invention advantageously mitigates engine torque variation when switching the deactivated cylinders to a reactivated state, thereby improving vehicle drivability while enhancing vehicle emissions quality.

Other objects, features, and advantages of the present invention will be readily appreciated upon a review of the subsequent description of the preferred embodiment and the appended claims, taken in conjunction with the accompanying Drawings.

DETAILED DESCRIPTION OF THE INVENTION

Figure 1:
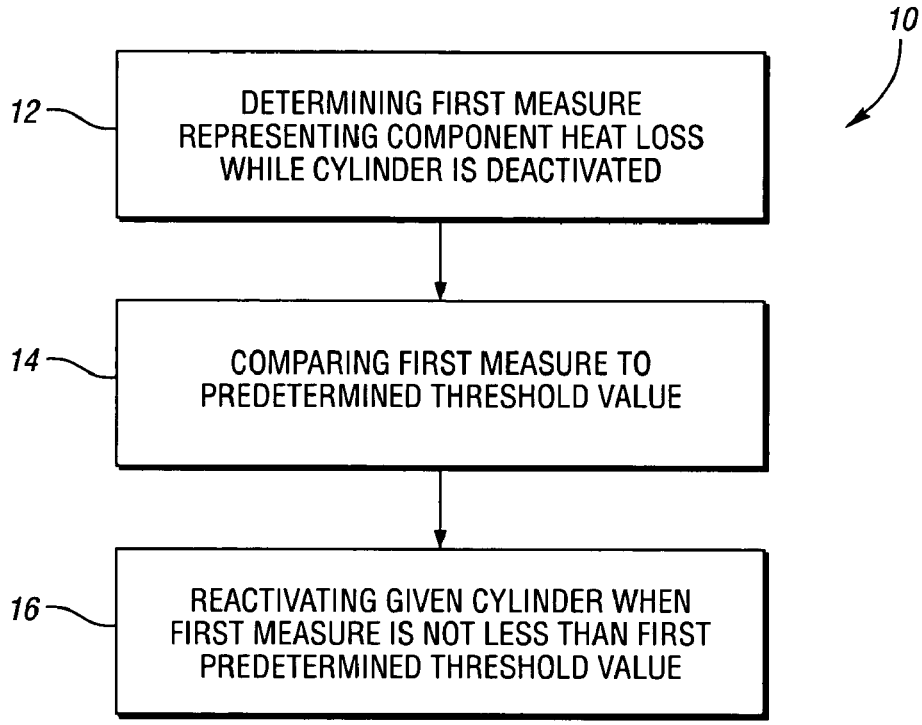
FIG. 1 is a flow chart illustrating the main steps of a method in accordance with an aspect of the invention for controlling a temperature of a component of an internal combustion engine associated with a deactivatable cylinder, wherein a given deactivated cylinder is reactivated to prevent the component temperature from falling below a minimum temperature.

A method 10 for controlling a temperature of a component, such as a piston ring, ring pack, or spark plug, associated with a given cylinder of an internal combustion engine that features an engine operating mode characterized by deactivation of the given cylinder is generally illustrated in FIG. 1. While the invention contemplates any suitable systems and methods for deactivating the given cylinder, including deactivatable valve train components, a constructed embodiment features an eight-cylinder engine in which four cylinders are selectively deactivated through use of deactivatable valve lifters as disclosed in U.S. patent publication no. U.S. 2004/0244751 A1, the teachings of which are hereby incorporated by reference.

As seen in FIG. 1, the method 10 generally includes determining, at block 12, a first measure representing a heat loss by the component that has occurred since the engine began operating in a cylinder-deactivation mode characterized by the deactivation of the given cylinder. As described further in connection with the exemplary method 30 illustrated in FIG. 3, while the invention contemplates determining the first measure based on any one or more suitable engine operating parameters, in the exemplary method 30, the heat loss is inferred from the number of engine cycles that have occurred since the given cylinder was deactivated. By way of example only, in the case of a four-stroke engine, an engine cycle is completed with every two complete revolutions of the engine's crankshaft.

Returning to FIG. 1, at block 14, the determined first measure is compared to a first predetermined threshold value representative of a maximum heat loss that can be experienced by the component before a reactivation of the given cylinder is required. At block 16, the given cylinder is reactivated when the determined first measure is not less than the first predetermined threshold value. In this manner, cylinder deactivation is enabled only so long as one or more engine components associated with the given cylinder are maintained at or above their respective minimum desired temperatures. By way of example only, in this manner, the temperature and pressure within the deactivated cylinders, and other such component attributes as spark plug temperature and deposits, can be managed to avoid increased emissions and increased oil consumption, and to reduce unintended output torque variation, upon reactivating a cylinder that has experienced excessive heat loss.

Figure 2:
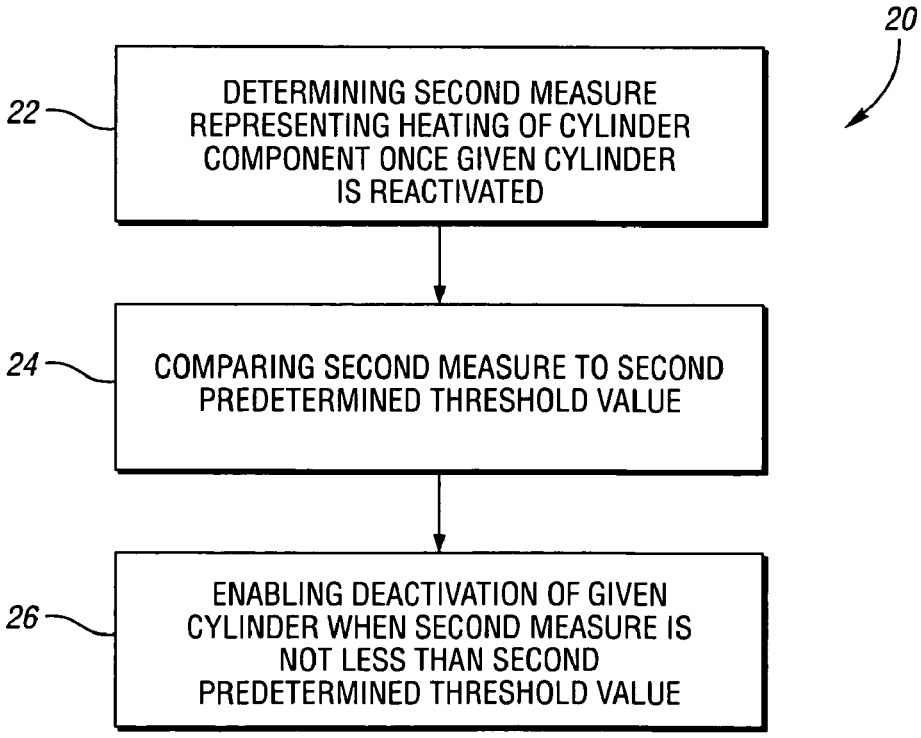
FIG. 2 is a flow chart illustrating the main steps of a method in accordance with another aspect of the invention for controlling the component's temperature, wherein subsequent deactivation of a reactivated cylinder is enabled only after the component's temperature has been raised to its nominal operating temperature.

As seen in FIG. 2, a correlative method 20 for controlling a temperature of one or more components associated with the given deactivatable cylinder, once the given cylinder has been reactivated after the engine has operated in a cylinder-deactivation mode, generally includes determining, at block 22, a second measure representing a heating of one or more of the components once the given cylinder has been reactivated. While the invention contemplates use of any one or more engine operating parameters from which to determine the second measure, as described below in connection with the exemplary method 30 illustrated in FIG. 3, values for a mass air flow rate, perhaps as otherwise conveniently calculated by the engine controller incident to vehicle fuel economy and emissions control, are accumulated or integrated over time to provide the desired metric representing the amount of heat that has been generated within the given cylinder subsequent to reactivation. The method 20 further includes comparing, at block 24, the second measure to a second predetermined threshold value representing a desired minimum amount of heating required to restore the components to respective activated operating temperatures; and enabling, at block 26, a subsequent deactivation of the given cylinder when the second measure is not less than the second predetermined threshold value.

Figure 3:
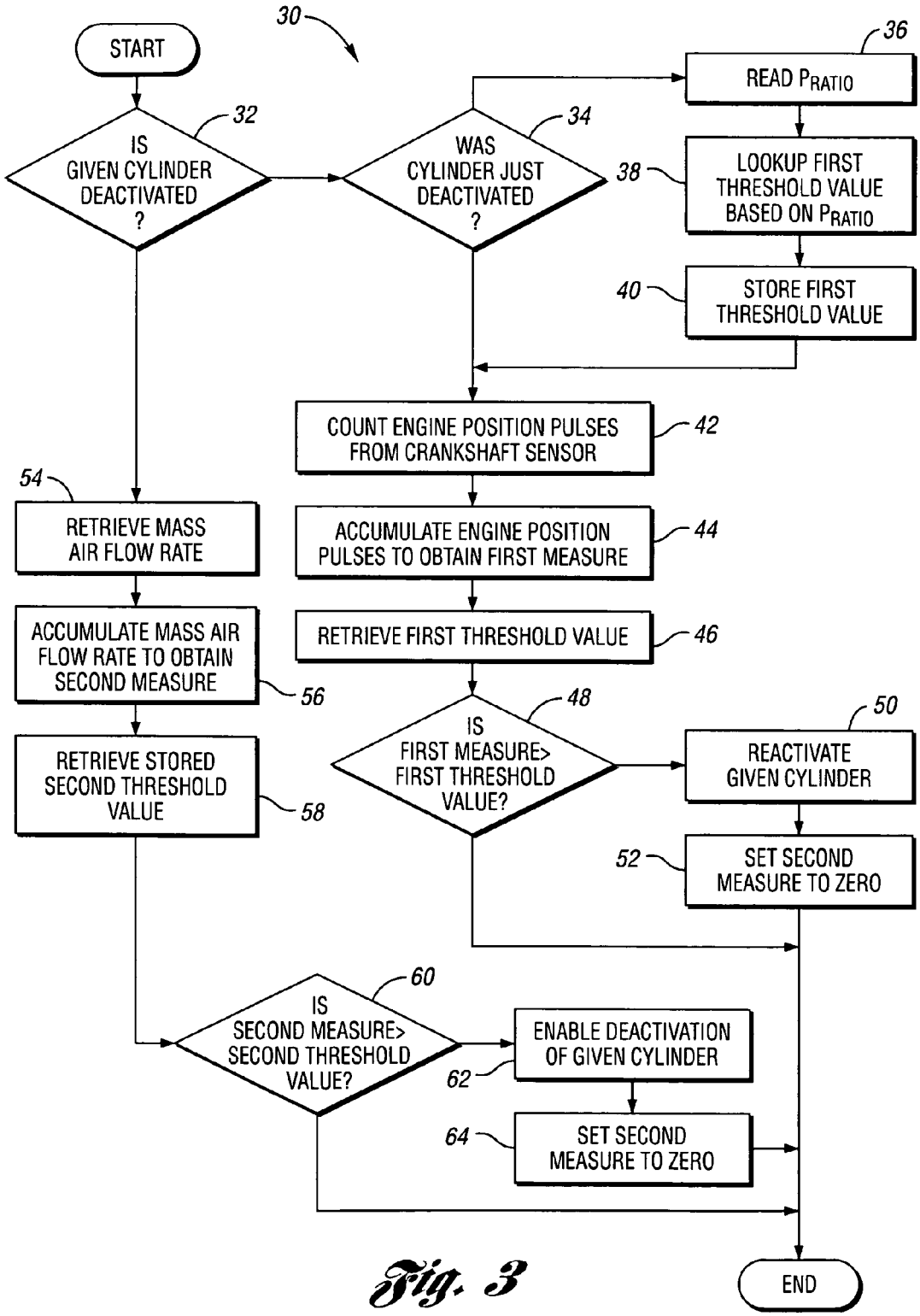
FIG. 3 is a flow chart illustrating in detail an exemplary method under the invention.

An exemplary method 30 for controlling a temperature of a component associated with a given deactivatable cylinder of an internal combustion engine, as stored as computer-executable code in a computer-readable storage medium for use by an engine controller (not shown), is illustrated in FIG. 3. After determining, at block 32, whether the engine is operating in a cylinder-deactivation mode, the controller determines whether the given cylinder was just deactivated at block 34. If the given cylinder was just deactivated, the controller determines the given cylinder's thermal initial conditions by reading a stored current value for an intake manifold pressure $P_{RATIO}$ at block 36; selects a first threshold value representing a maximum permitted component or cylinder heat loss from a lookup table of calibrated values, based upon the current intake manifold pressure value $P_{RATIO}$ at block 38, and stores the selected first threshold value in a suitable storage medium for subsequent use. As will be seen below, in the exemplary method 30, where the first heat-loss measure is itself expressed in terms of accumulated engine cycles, the first threshold value represents a maximum number of engine cycles that can occur before the given cylinder must be reactivated in order to prevent excessive cylinder and/or component heat loss.

Referring again to FIG. 3, and as noted in the preceding paragraph, the exemplary method 30 infers component or cylinder heat loss from the number of engine cycles that have occurred since the given cylinder was deactivated, based upon information generated by a crankshaft sensor. Thus, after determining at block 34 that a cylinder deactivation event is on-going, or after storing at block 40 the first threshold value, at block 42, the controller counts the engine position pulses that have been generated, for example, by a Hall-effect crankshaft sensor during a reference time period. At block 44, the counted engine position pulses are accumulated to obtain the first heat-loss measure. After retrieving the first threshold value at block 46, the controller compares the first heat-loss measure to the first threshold value at block 48. If the first heat-loss measure is greater than the first threshold value, the controller reactivates the given cylinder at block 50, and resets a stored value for a second measure representing cylinder heat-gain to zero at block 52, for subsequent use as described below.

If, at block 32 of FIG. 3, the engine is not being operated with the given cylinder in a deactivated mode, at block 54, the controller retrieves a stored value representative of a current mass air flow rate, for example, as otherwise calculated by the controller incident to vehicle fuel economy and emissions control, and, at block 56, accumulates the mass air flow rates over time to obtain the second measure representing the heat that has been generated within the given cylinder subsequent to reactivation. At block 58, the controller retrieves a stored second threshold value representing a desired minimum amount of heating required to restore the components to respective activated operating temperatures, and, at block 58, the controller compares the second heat-gain measure to the second threshold value at block 60. If the second heat-gain measure is greater than the second threshold value, the controller enables subsequent cylinder deactivation at block 62, as by setting a suitable cylinder-deactivation-enable flag. And, at block 64, the controller resets the first heat-loss measure, for use when subsequently operating the engine in the cylinder-deactivation mode.

While the above description constitutes the preferred embodiment, it will be appreciated that the invention is susceptible to modification, variation and change without departing from the proper scope and fair meaning of the subjoined claims.

What is claimed is:

1. A method of controlling a temperature of a component of an internal combustion engine associated with a deactivatable cylinder after the engine is switched from a first operating mode characterized by an activation of the cylinder to a second operating mode characterized by a deactivation of the cylinder, the method comprising:

determining, during the second operating mode, a first measure representative of a component heat loss by determining a first value representing a first engine operating parameter, and accumulating in the first values when operating the engine in the second operating mode; and switching from the second operating mode back to the first operating mode by reactivating the cylinder when the first measure exceeds a first threshold value.

2. The method of claim 1, wherein the first value represents a number of engine cycles over a sampling period.

3. The method of claim 2, wherein the first value represents a number of engine position pulses generated by an engine crankshaft sensor over a sampling period.

4. The method of claim 1, further including:

determining a second measure representative of a heating of the component after first switching from the second operating mode back to the first operating mode; and allowing a switching from the first engine operating mode back to the second engine operating mode when the second measure exceeds a second threshold.

5. The method of claim 1, wherein the first threshold is determined based on at least one second engine operating parameter at or immediately prior to cylinder deactivation.

6. The method of claim 5, wherein the second operating parameter is one of the group consisting of an engine speed, an engine load indicator, an intake manifold pressure, an air-fuel charge temperature, an ambient air temperature, and an engine coolant temperature.

7. The method of claim 5, wherein determining the second measure includes:

determining a second value representing a second engine operating parameter; and accumulating the second values when operating the engine in the first engine operating mode.

8. The method of claim 7, wherein the second value is representative of engine load.

9. The method of claim 8, wherein the second value represents a mass air flow into the engine over a sampling period.

10. A method of controlling an internal combustion engine adapted to operate in a cylinder-deactivation mode, the cylinder-deactivation mode being characterized in that each intake and exhaust valve associated with a given deactivated cylinder is maintained in a respective closed position, the method comprising:

determining, while operating the engine in the cylinder-deactivation mode, a first measure representative of a heat loss within the given cylinder since a deactivation of the given cylinder; and discontinuing the cylinder-deactivation mode when the first measure exceeds a first threshold value based on at least one of the group consisting of an engine speed, an engine load indicator, an intake manifold pressure, an air-fuel charge temperature, an ambient air temperature, and an engine coolant temperature.

11. The method of claim 10, wherein the first measure is based on a number of engine cycles that have occurred while operating the engine in the cylinder-deactivation mode.

12. The method of claim 11, wherein determining the first measure includes accumulating engine position pulses generated by an engine crankshaft sensor.

13. The method of claim 10, further including:

determining a second measure representative of a heating of the cylinder after discontinuing the cylinder-deactivation mode; and again allowing engine operation in the cylinder-deactivation mode when the second measure exceeds a second threshold.

14. The method of claim 13, wherein determining the second measure includes:

determining a second value representing a mass air flow into the engine; and accumulating the second values.

15. A computer-readable storage medium including computer executable code for controlling an internal combustion engine adapted to operate in a cylinder-deactivation mode, the cylinder-deactivation mode being characterized in that each intake and exhaust valve associated with a given deactivated cylinder is maintained in a respective closed position, the storage medium including:

code for determining a first measure representative of a heat loss within the given cylinder while operating the engine in the cylinder-deactivation mode;

code for discontinuing the cylinder-deactivation mode when the first measure exceeds a first threshold value; and code for determining the first threshold value based on at least one of the group consisting of one of the group consisting of an engine speed, an engine load indicator, an intake manifold pressure, an air-fuel charge temperature, an ambient air temperature, and an engine coolant temperature.

16. The storage medium of claim 15, wherein code for determining the first measure includes code for determining a number of engine cycles that have occurred while operating the engine in the cylinder-deactivation mode.

17. The storage medium of claim 16, wherein the code for determining the first measure includes code for accumulating engine position pulses generated by an engine crankshaft sensor.

18. The storage medium of claim 16, further including:

determining a second measure representative of a heating of the cylinder after discontinuing the cylinder-deactivation mode; and again allowing engine operation in the cylinder-deactivation mode when the second measure exceeds a second threshold.

19. The storage medium of claim 18, wherein the code for determining the second measure includes:

code for determining a second value representing one of a mass air flow and a fuel flow into the engine; and code for accumulating the second values.

* * * * *